US008234845B2

(12) United States Patent
Fairweather et al.

(10) Patent No.: US 8,234,845 B2
(45) Date of Patent: Aug. 7, 2012

(54) METHOD OF SENSING PACK INSERTION AT CREASE LINE OF ENVELOPE

(75) Inventors: James A. Fairweather, Milford, CT (US); Gary S. Jacobson, Norwalk, CT (US); Robert J. Allen, Shelton, CT (US); George J. Doutney, Sandy Hook, CT (US); Michael J. Lorello, Guilford, CT (US)

(73) Assignee: Pitney Bowes Inc., Stamford, CT (US)

( * ) Notice: Subject to any disclaimer, the term of this patent is extended or adjusted under 35 U.S.C. 154(b) by 1195 days.

(21) Appl. No.: 11/787,041

(22) Filed: Apr. 13, 2007

(65) Prior Publication Data

US 2007/0251192 A1 Nov. 1, 2007

Related U.S. Application Data

(60) Provisional application No. 60/796,123, filed on Apr. 27, 2006, provisional application No. 60/795,819, filed on Apr. 28, 2006.

(51) Int. Cl.
*B65B 11/48* (2006.01)

(52) U.S. Cl. ..... 53/460; 53/58; 53/67; 53/74; 53/266.1

(58) Field of Classification Search ..... 53/52, 57, 53/58, 67, 74–76, 117, 266.1, 460, 473, 505, 53/569; 270/58.06

See application file for complete search history.

(56) References Cited

U.S. PATENT DOCUMENTS

| | | | | | |
|---|---|---|---|---|---|
| 3,614,419 | A * | 10/1971 | Daughton et al. | 377/8 |
| 4,020,615 | A * | 5/1977 | Irvine et al. | 53/473 |
| 4,353,197 | A * | 10/1982 | Stevens et al. | 53/492 |
| 4,843,802 | A * | 7/1989 | Noll | 53/505 |
| 5,134,834 | A * | 8/1992 | Hayduchok | 53/492 |
| 5,314,566 | A * | 5/1994 | Gallagher et al. | 156/441.5 |
| 5,406,771 | A * | 4/1995 | Dronsfield | 53/56 |
| 6,122,899 | A * | 9/2000 | Soderling | 53/460 |
| 6,891,142 | B2 * | 5/2005 | Ogawa | 250/205 |
| 7,232,122 | B2 * | 6/2007 | Mayer et al. | 271/4.01 |

* cited by examiner

*Primary Examiner* — Tranh Truong

(74) *Attorney, Agent, or Firm* — Steven J. Shapiro; Charles R. Malandra, Jr.

(57) ABSTRACT

A thru-beam sensor is positioned such that the beam passes through the crease line of the envelope when the envelope is parked in the insertion area. As the envelope enters the insertion area, the through beam sensor is set to current level A. The sensor is used to accurately position the envelope based on the passing of the lead edge. Once the envelope is in position, the current in the thru-beam emitter pair is raised until the envelope is no longer obstructing the line of sight of the sensor. From this state, the insert or plurality of inserts that are entering the accumulator can be detected, as the presence of the inserts will inhibit light transmission between the emitter and receiver. Using the sensor system proposed here, the inserts trailing edge can be detected at the crease line of the envelope.

13 Claims, 8 Drawing Sheets

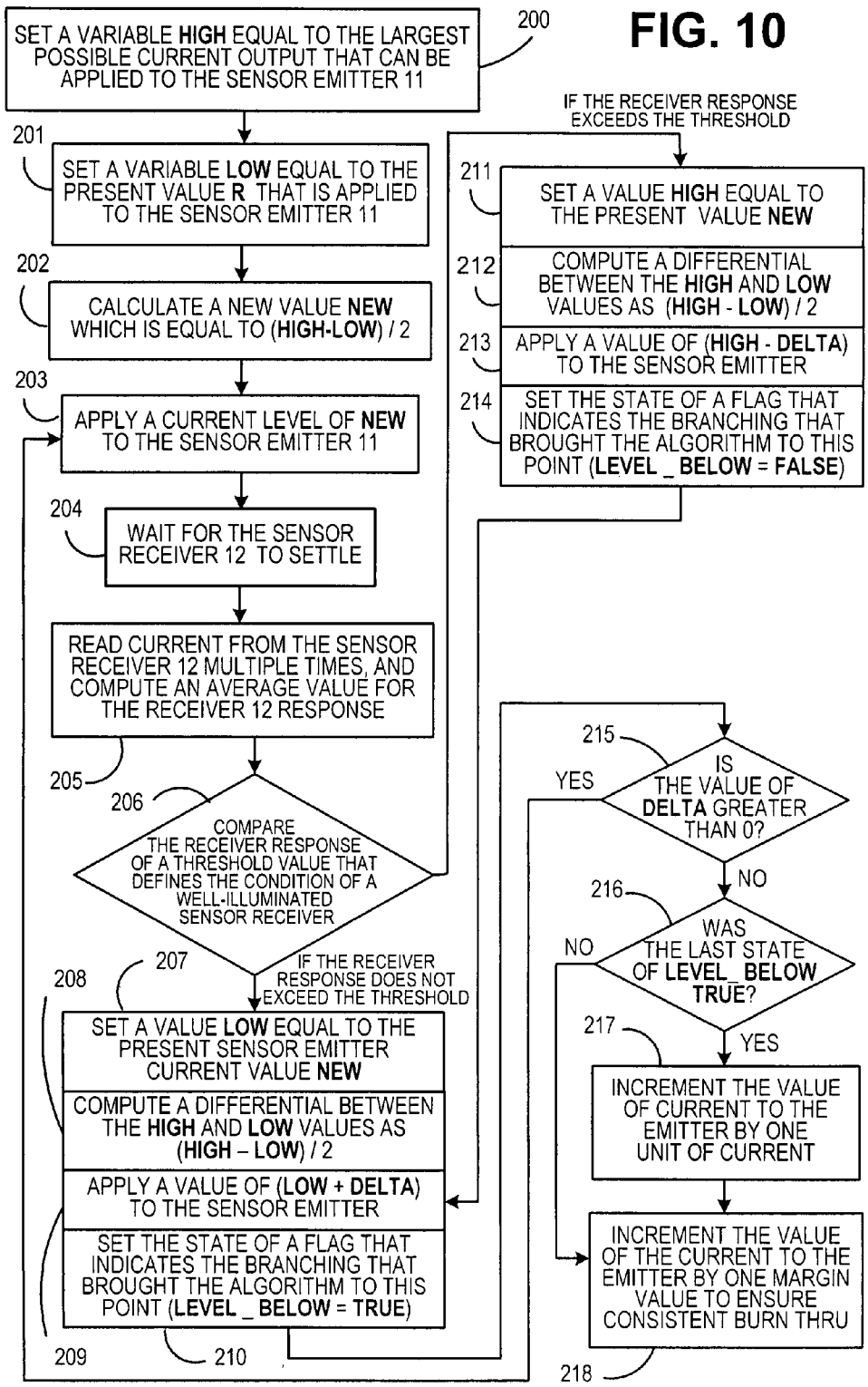
FIG. 10
200
SET A VARIABLE HIGH EQUAL TO THE LARGEST POSSIBLE CURRENT OUTPUT THAT CAN BE APPLIED TO THE SENSOR EMITTER 11
201
SET A VARIABLE LOW EQUAL TO THE PRESENT VALUE R THAT IS APPLIED TO THE SENSOR EMITTER 11
202
CALCULATE A NEW VALUE NEW WHICH IS EQUAL TO (HIGH-LOW) / 2
203
APPLY A CURRENT LEVEL OF NEW TO THE SENSOR EMITTER 11
204
WAIT FOR THE SENSOR RECEIVER 12 TO SETTLE
READ CURRENT FROM THE SENSOR RECEIVER 12 MULTIPLE TIMES, AND COMPUTE AN AVERAGE VALUE FOR THE RECEIVER 12 RESPONSE
205
206
COMPARE THE RECEIVER RESPONSE OF A THRESHOLD VALUE THAT DEFINES THE CONDITION OF A WELL-ILLUMINATED SENSOR RECEIVER
IF THE RECEIVER RESPONSE DOES NOT EXCEED THE THRESHOLD
207
208
SET A VALUE LOW EQUAL TO THE PRESENT SENSOR EMITTER CURRENT VALUE NEW
COMPUTE A DIFFERENTIAL BETWEEN THE HIGH AND LOW VALUES AS (HIGH – LOW) / 2
APPLY A VALUE OF (LOW + DELTA) TO THE SENSOR EMITTER
SET THE STATE OF A FLAG THAT INDICATES THE BRANCHING THAT BROUGHT THE ALGORITHM TO THIS POINT (LEVEL _ BELOW = TRUE)
209
210
IF THE RECEIVER RESPONSE EXCEEDS THE THRESHOLD
211
SET A VALUE HIGH EQUAL TO THE PRESENT VALUE NEW
212
COMPUTE A DIFFERENTIAL BETWEEN THE HIGH AND LOW VALUES AS (HIGH - LOW) / 2
213
APPLY A VALUE OF (HIGH - DELTA) TO THE SENSOR EMITTER
214
SET THE STATE OF A FLAG THAT INDICATES THE BRANCHING THAT BROUGHT THE ALGORITHM TO THIS POINT (LEVEL _ BELOW = FALSE)
215
IS THE VALUE OF DELTA GREATER THAN 0?
YES
NO
216
WAS THE LAST STATE OF LEVEL_ BELOW TRUE?
NO
YES
217
INCREMENT THE VALUE OF CURRENT TO THE EMITTER BY ONE UNIT OF CURRENT
INCREMENT THE VALUE OF THE CURRENT TO THE EMITTER BY ONE MARGIN VALUE TO ENSURE CONSISTENT BURN THRU
218

METHOD OF SENSING PACK INSERTION AT CREASE LINE OF ENVELOPE

This Application claims the benefit of the filing dates of U.S. Provisional Application No. 60/796,123 filed Apr. 27, 2006, which is owned by the assignee of the present Application and U.S. Provisional Application No. 60/795,819 filed Apr. 28, 2006, which is owned by the assignee of the present Application.

FIELD OF THE INVENTION

The invention relates generally to insertions systems, and more particularly to a method of sensing the insertion of an insert into an envelope at the crease line of the envelope.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford, Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

In an insertion system, the detection of the inserts or pack's entry into the envelope is customarily done based on the "time of flight" of a trail edge of the pack to be inserted off of a sensor in the mail path. Because the envelope exists in the same spatial region as the pack to be inserted, a direct detection of the trail edge at the crease line is not performed. As a result, a small amount of extra "overdrive" time must be added to the machine cycle to ensure that the pack is fully inserted. In addition, insertion crashes can occur downstream of the trail edge signal, and improperly inserted collations can be exited from the system.

Thus, a disadvantage of the prior art is that some "open-loop" insertion systems must continue the drive to the pack off of an upstream sensor, and rely on the flight time of the pack, as well as confidence in the insertion system to provide verification that the insertion process has completed successfully. Another disadvantage of the prior art is that additional time must be included in all insertion cycles to allow for the overdrive of the insert.

In an insertion system, the detection of the inserts or pack's entry into the envelope may be done by a thru-beam light emitting diode (LED) sensor. The proper current drive level for a LED component of the sensor system must be set to allow the sensor to see through the flap and detect the insert as the insert enters the envelope. The drive current to the LED component of the sensor system must be set quickly after the envelope is parked at the insertion position and before the insert is inserted into the envelope. When a new current drive level is set the photo transistor component of the sensor system and the LED component of the sensor system must be allowed to stabilize before a measurement of the phototransistor current is made to determine if the LED light source intensity has been increased sufficiently to illuminate through the envelope flap. In this state an insert entering the envelope will decrease the illumination on the phototransistor and cause a measurable decrease in the photo transistor current. Because of the stabilization time, a linear search from low current to high current will take too long to identify the light transmission threshold. It is to be noted that a fixed current value applied to the LED does not create a consistent transmission of light because of variations from one envelope type to another envelope type, i.e., a white envelope to a kraft envelope, etc.

Variations in the light emission and reception properties of the sensor components and supporting circuitry may also prohibit the use of a fixed current value.

Thus, another disadvantage of the prior art is that linear search techniques are too slow and fixed value techniques are unreliable due to the variations described above,

SUMMARY OF THE INVENTION

This invention overcomes the disadvantages of the prior art by providing a sensor that allows the system to determine precisely when the insertion process is complete, allowing the inserted pack to depart the insertion system at the earliest possible time.

In this invention, a thru-beam sensor is positioned such that the beam passes through the crease line of the envelope when the envelope is parked in the insertion area. As the envelope enters the insertion area, the through beam sensor is set to current level A. The sensor is used to accurately position the envelope based on the passing of the lead edge. Once the envelope is in position, the current in the thru-beam emitter pair is raised until the envelope is no longer obstructing the line of sight of the sensor. From this state, the insert or plurality of inserts that are entering the accumulator can be detected, as the presence of the inserts will inhibit light transmission between the emitter and receiver. Using the sensor system proposed here, the inserts trailing edge can be detected at the crease line of the envelope.

An alternate embodiment of this invention overcomes the disadvantages of the prior art by providing a heuristic modified binary search algorithm which will arrive at the correct LED envelope flap sensor drive current in a maximum of eight tries. Thus, the system may transition from a state 1 in which the sensor is capable of detecting the presence of a single thickness of media, i.e., an envelope flap to a state 2 in which the system is able to detect the presence of a document insert, while the document insert is being inserted into the envelope. The time required to transition from state 1 to state 2 is minimized by the above. The method will insure a correct current level setting in state 2 that is capable of detecting thin document inserts. Thus, the correct current setting is insured when there is significant variations in media and system components.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

FIG. 10 is a flow chart of a modified binary search that controls the transition from state 1 to state 2 for the insertion system shown in FIGS. 6-9.

DETAILED DESCRIPTION OF THE PRESENT INVENTION

Figure 1:
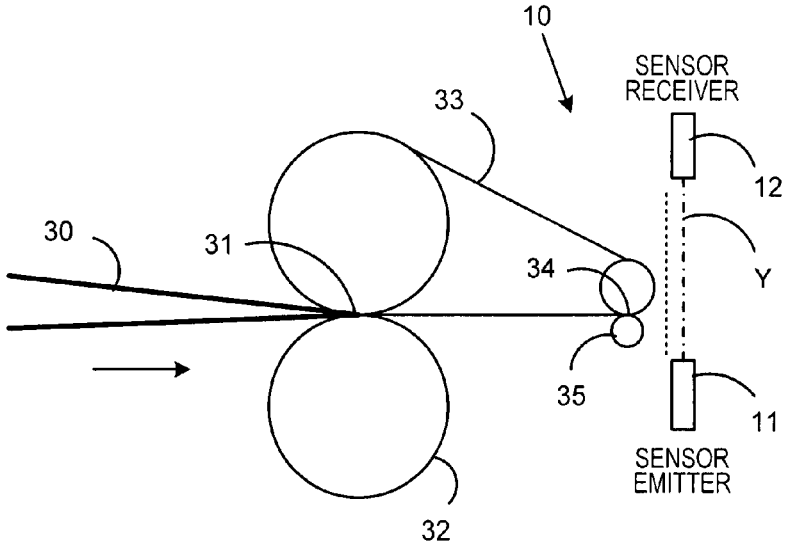
FIG. 1 is a drawing of an insertion system before an envelope has arrived and an insert inserted into the envelope.

In describing the present invention, reference is made to the drawings, wherein similar reference numerals designate similar elements in the various views.

Referring now to the drawings in detail and more particularly to FIG. 1 the insertion system 10 is shown before an envelope has arrived and an insert inserted into the envelope. Inserts 30 which may comprise one or more sheets of folded or unfolded material are positioned at the entry of a nip 31. Nip 31 is comprised of an idler roller 32 and a belt drive 33. A region of transport of inserts 30 exists between nip 31 and nip 34. Nip 34 is comprised of an idler roller 35 and a portion of belt drive 33. Sensor emitter 11 is supplied with an electric current R and sensor receiver 12 is receiving the light produced by sensor emitter 11 along path Y and producing a signal state indicating that the path Y is not blocked.

Figure 2:
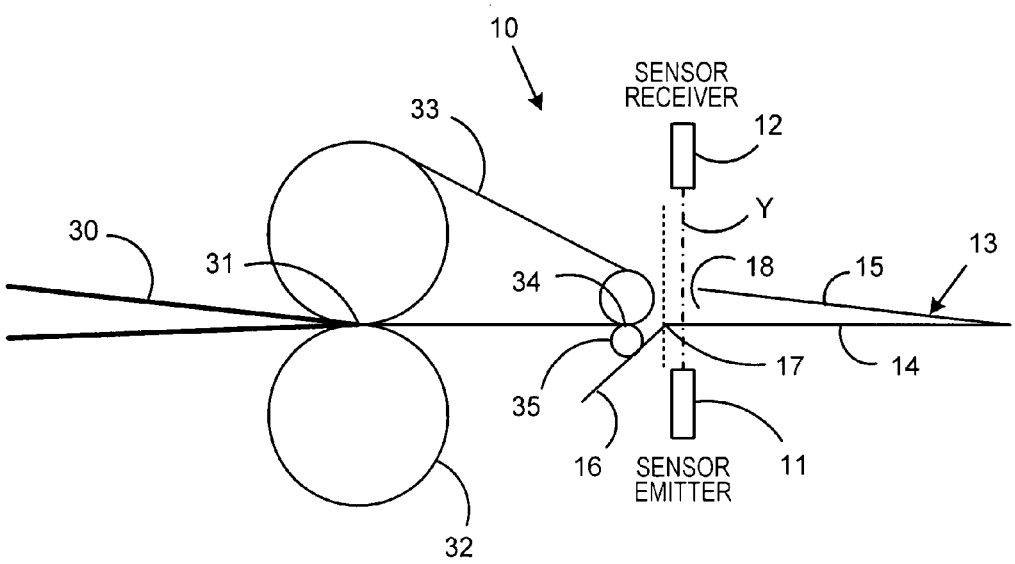
FIG. 2 is a drawing of an insertion system showing an insert staged for insert and an envelope in a position to receive said insert.

FIG. 2 is a drawing of an insertion system showing an insert staged for insert and an envelope in a position to receive said insert. Envelope 13 has a front section 14 having a length "A", a back section 15 having a length "B", a flap 16 having a length "C", envelope hinge point 17, and a throat 18. Sensor emitter 11 is supplied with an electric current R and because envelope 13 intercepts the path Y the light traveling from Sensor emitter 11 does not reach sensor receiver 12. Sensor receiver 12 thus, produces a signal state indicating that the path Y is blocked. At this point the current supplied to sensor emitter 11 is increased to a current S in accordance with the state diagram shown in FIG. 5. The increase in current increases the light emission of sensor emitter 11 and the light diffusing through envelope 13 now reaches sensor receiver 12 along path Y. Sensor 12 now produces a signal state indicating that the path Y is not blocked.

Figure 3:
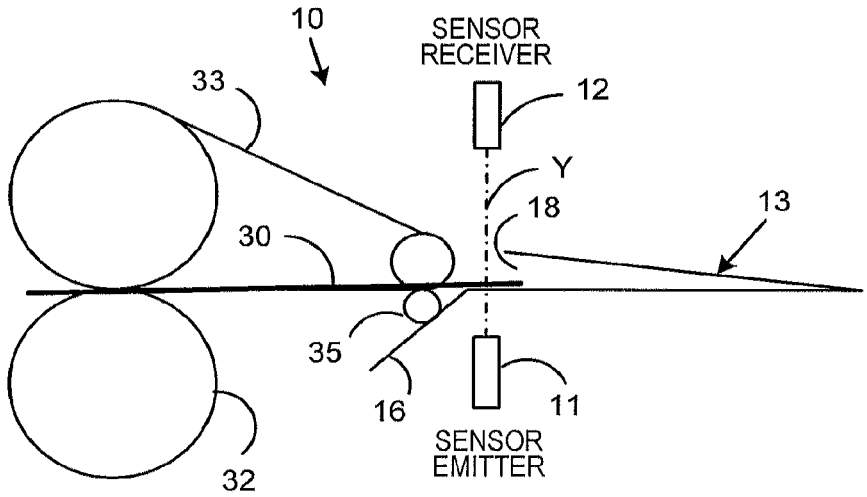
FIG. 3 is a drawing of an insertion system with an insert partially inserted into an envelope and blocking the thru beam sensor.

FIG. 3 shows when the inserts 30 arrives at envelope throat 13. The arrival of inserts 30 at envelope throat 18 obstructs the path Y between the sensor emitter 11 and sensor receiver 12. The light traveling from sensor emitter 11 does not reach sensor receiver 12 causing the sensor receiver 12 to produce a signal state that the path Y is blocked. Thus, sensor emitter 11 and sensor receiver 12 have been used to sense envelope 13 and inserts 30 in the same path Y before envelope 13 has left path Y. Hence, the process times of sensor emitter 11 and sensor receiver 12 may be used to monitor inserts iams and envelope iams.

Figure 4:
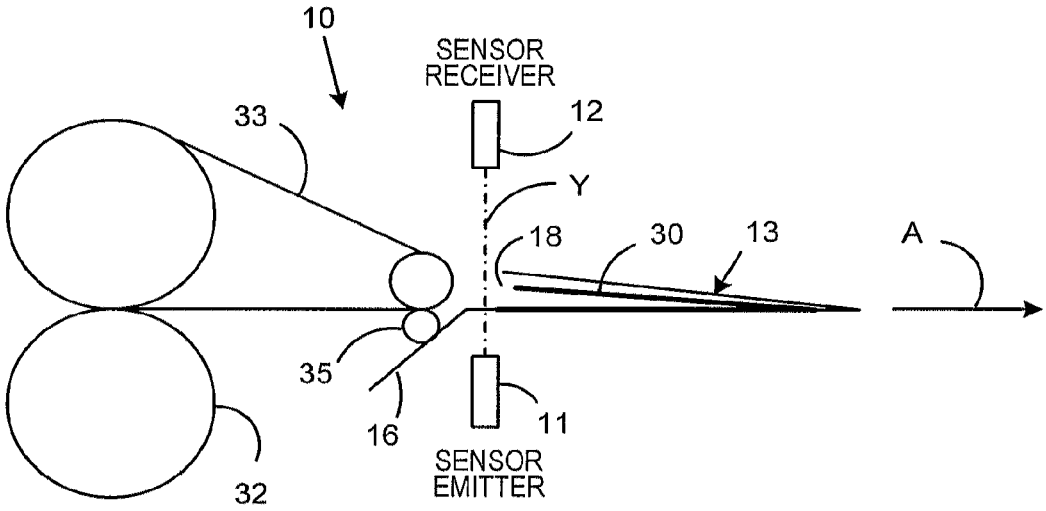
FIG. 4 is a drawing of an insertion system with an insert fully inserted into the envelope.

FIG. 4 is a drawing of an insertion system with an insert fully inserted into the envelope. The inserts 30 have been driven by the belt drive 33 and the momentum of inserts 30 has carried inserts 30 fully into throat 18 of envelope 13. The trailing edge of inserts 30 has crossed path Y and no longer obstructs the light passing from sensor emitter 11 to sensor receiver 12. Thus, sensor emitter 11 and sensor receiver 12 produce a signal state indicating that the path Y is not blocked. At this point the sensor emitter 11 current is changed from its elevated current S to the reduced current R. The sensor receiver 12 can no longer sense the light produced by sensor emitter 11 and produces a signal state indicating that the path Y is blocked.

The envelope 13 and inserts 30 are then ejected from insertion system 10 in the direction shown by arrow A and path Y is no longer obstructed by the envelope 13. Thus, sensor receiver 12 has a signal state indicating that path Y is not blocked and system 10 has returned to the condition shown in FIG. 1.

Figure 5:
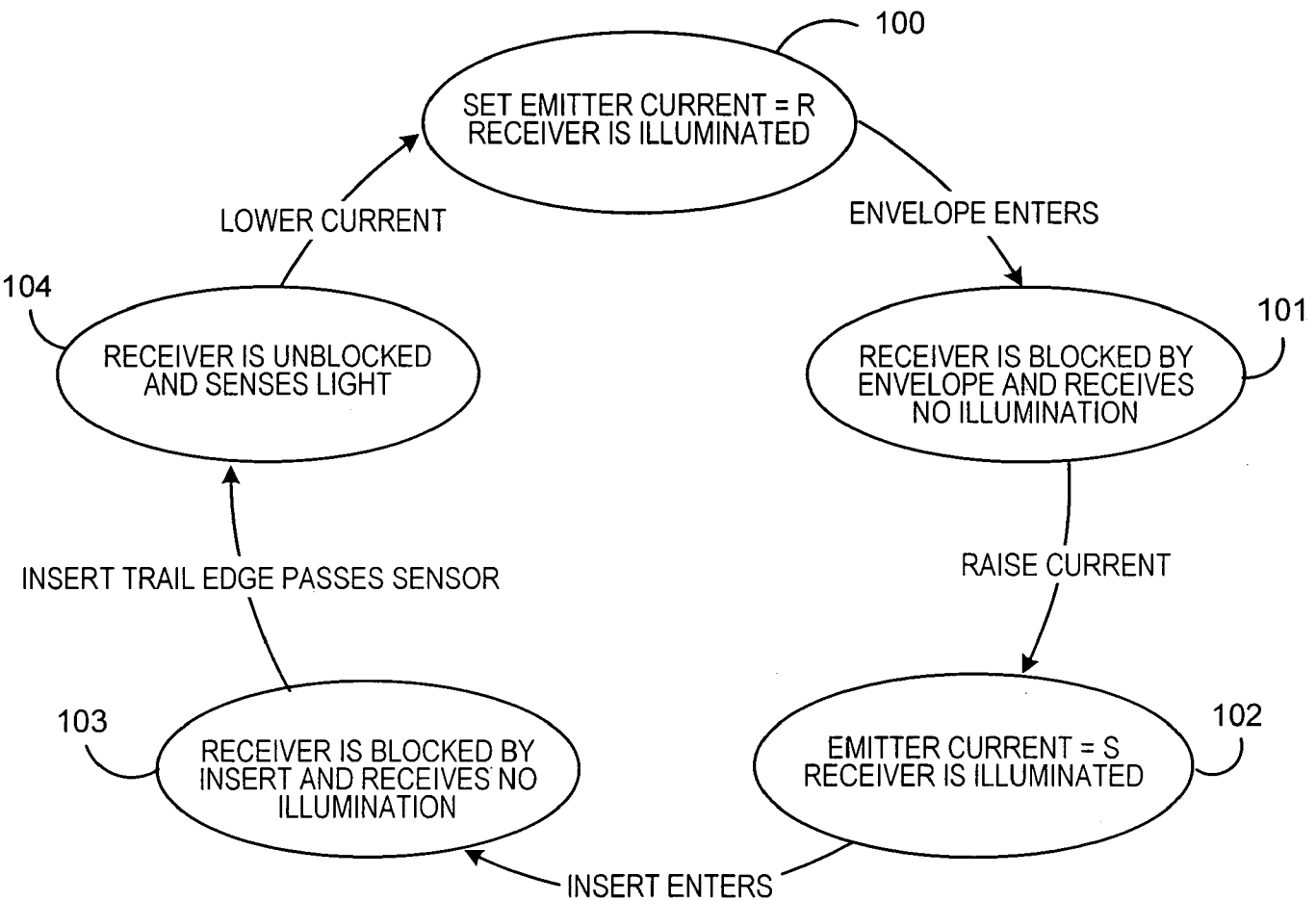
FIG. 5 is a diagram of the states of sensor emitter 11 and sensor receiver 12.

FIG. 5 is a diagram of the states of sensor emitter 11 and sensor receiver 12, which describe the current applied to sensor emitter 11 and the response of sensor receiver 12. In state 100 receiver 12 and emitter 11 are in a configuration corresponding to the system 10 shown in FIG. 1, The emitter 11 current is set to R and the receiver 12 is illuminated, producing a signal state indicating that the path Y is not blocked.

A state transition from state 100 to state 101 is caused by an envelope entering the insertion system. At this point the system 10 executes the algorithm described in FIG. 6 which increases the current to a level S. The system is now in the configuration shown in FIG. 2 and transitions to state 102. In state 102 the emitter 11 current equals S and the receiver 12 is illuminated producing a signal state indicating that the path Y is not blocked.

When an insert enters the insertion system and crosses path Y as shown in FIG. 3, the system transitions from state 102 to state 103. In this state path Y is blocked by the insert and the receiver 12 is not illuminated, thus producing a signal indicating path Y is blocked. When the trailing edge of the insert crosses path Y, the receiver 12 is not blocked and senses the illumination provided by the emitter 11. This causes the system to transition from state 103 to state 104, which is shown in FIG. 4.

At this juncture the current to the emitter 11 is restored to a level S and the envelope containing the insert exits the system. The system 10 then transitions back to state 100.

Processing errors may be detected based upon an expected time of transition for this sensor, thereby allowing a timely shutdown of the system in the event of error.

Similar system may be used to detect successive media into an accumulation area and to connect media items accumulated in a stacked form in media processing equipment.

Figure 6:
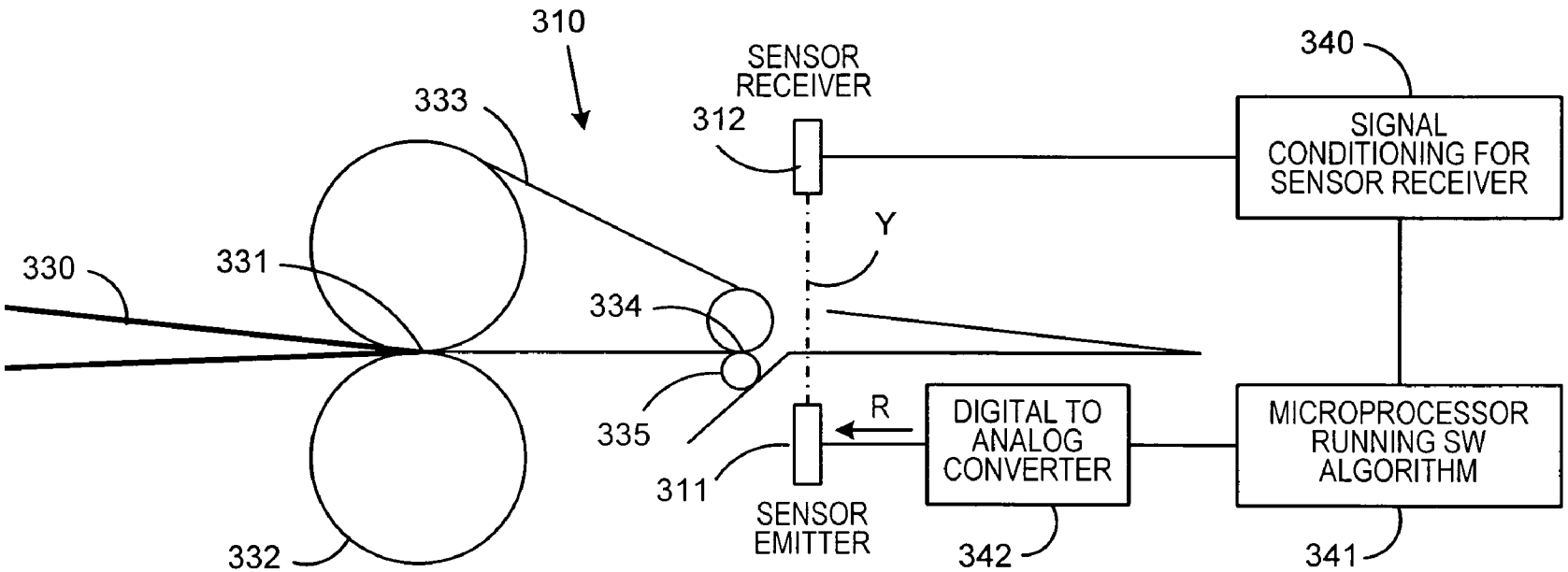
FIG. 6 is a drawing of an alternate embodiment of an insertion system showing an insert staged for insertion.

FIG. 6 is an alternate embodiment of this invention. The insertion system 310 is shown before an envelope has arrived and an insert inserted into the envelope. Inserts 330 which may comprise one or more sheets of folded or unfolded material are positioned at the entry of a nip 331. Nip 331 is comprised of an idler roller 332 and a belt drive 333. A region of transport of inserts 330 exists between nip 331 and nip 334. Nip 334 is comprised of an idler roller 335 and a portion of belt drive 333. Sensor emitter 311 is supplied with an electric current R and sensor receiver 12 is receiving the light produced by sensor emitter 311 along path Y and producing a signal state indicating that the path Y is not blocked.

Signal conditioning for sensor receiver 340 is coupled to sensor receiver 312 and microprocessor running software algorithm 341 is coupled to digital to analog converter 342. Digital to analog converter 342 is coupled to the current R of sensor emitter 11. Sensor emitter 311 emits light in proportion to the current R supplied by digital to analog converter 342. Microprocessor 341 runs the state diagram described in FIG. 5 to adjust the current R in response to the signal received from sensor receiver 312 through signal conditioning for sensor receiver 340.

In FIG. 6 insertion system 310 has no envelopes. The state diagram in FIG. 5 transitions the system to a first state, state 100, in which the sensor is capable of detecting the presence of a single thickness of media, i.e., an envelope flap.

Figure 7:
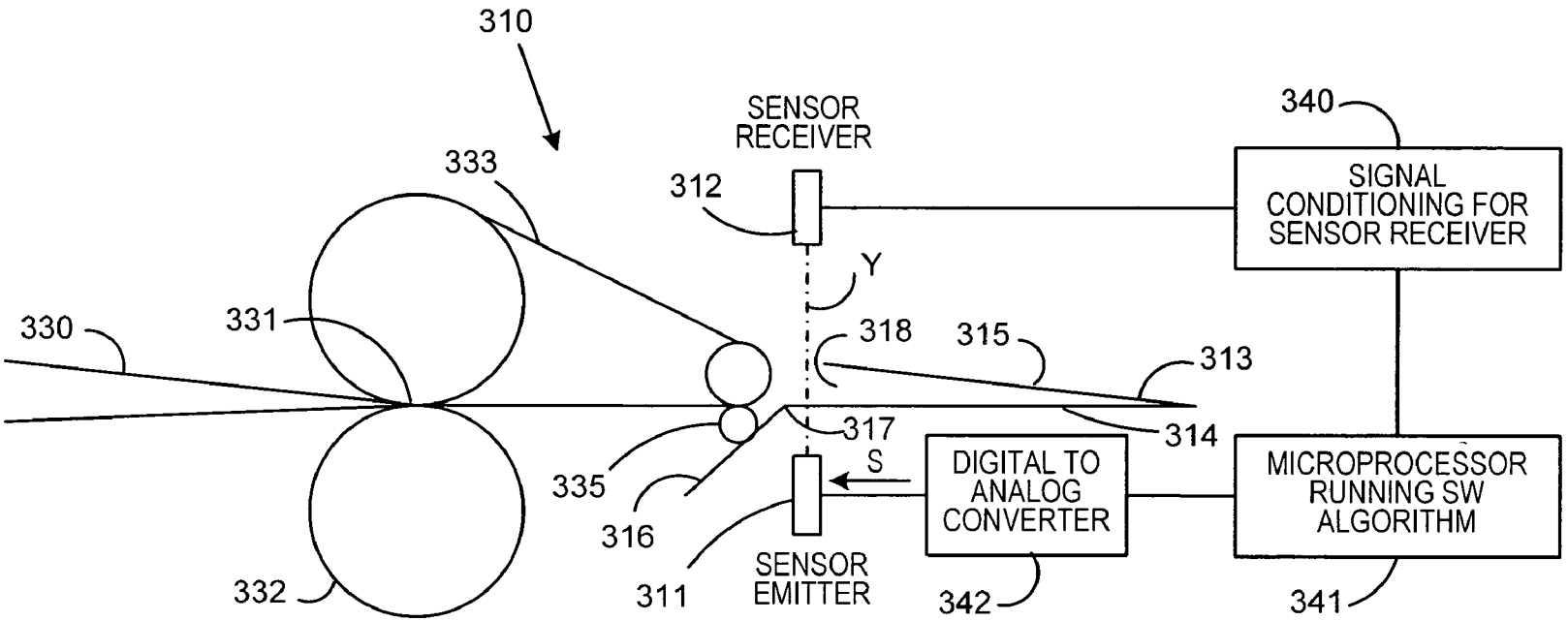
FIG. 7 is a drawing of the insertion system shown in FIG. 6 showing an insert staged for insertion and an envelope in a position to receive said insert.

FIG. 7 is a drawing of the insertion system shown in FIG. 6 showing an insert staged for insert and an envelope in a position to receive said insert. Envelope 313 has a front section 314 having a length "A", a back section 315 having a length "B", a flap 316 having a length "C", envelope hinge point 317, and a throat 318. Sensor emitter 311 is supplied with an electric current R and because envelope 313 intercepts the path Y the light traveling from Sensor emitter 311 does not reach sensor receiver 312. Sensor receiver 312 thus, produces a signal state indicating that the path Y is blocked. The state diagram in FIG. 5 transitions the system 310 to a second state, state 102, in which the system 310 is able to detect the presence of an insert as the insert is being inserted into the envelope. At this point the current supplied to sensor emitter 311 is increased to a current S in accordance with the state diagram shown in FIG. 5. The increase in current increases the light emission of sensor emitter 311 and the light diffusing through envelope 313 now reaches sensor receiver 312 along path Y. Sensor 312 now produces a signal state indicating that the path Y is not blocked.

Figure 8:
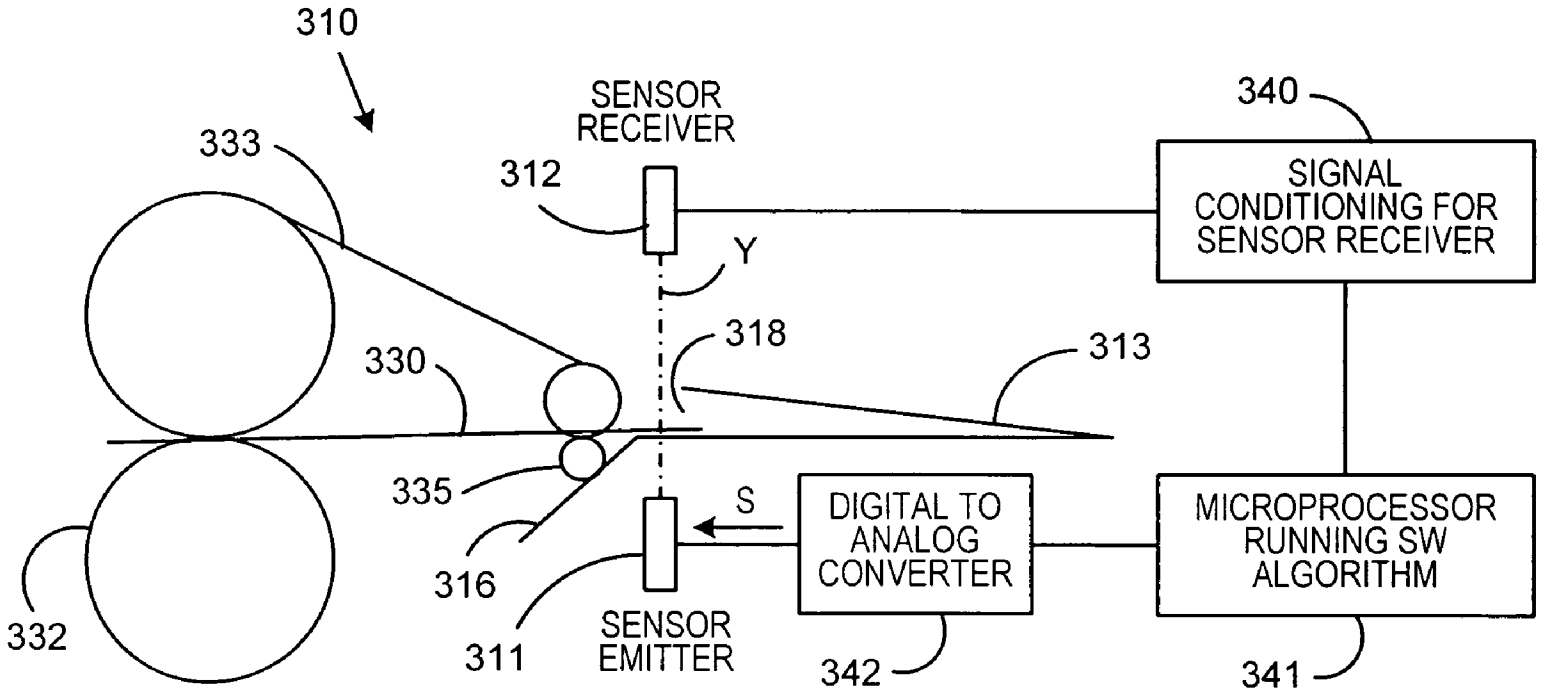
FIG. 8 is a drawing of the insertion system shown in FIG. 6 with an insert partially inserted into an envelope and blocking the thru beam sensor.

FIG. 8 shows when the inserts 330 arrives at envelope throat 313. The arrival of inserts 330 at envelope throat 318 obstructs the path Y between the sensor emitter 311 and sensor receiver 312. The light traveling from sensor emitter 311 does not reach sensor receiver 312 causing the sensor receiver 312 to produce a signal state that the path Y is blocked. Thus, sensor emitter 311 and sensor receiver 312 have been used to sense envelope 313 and inserts 330 in the same path Y before envelope 313 has left path Y.

Figure 9:
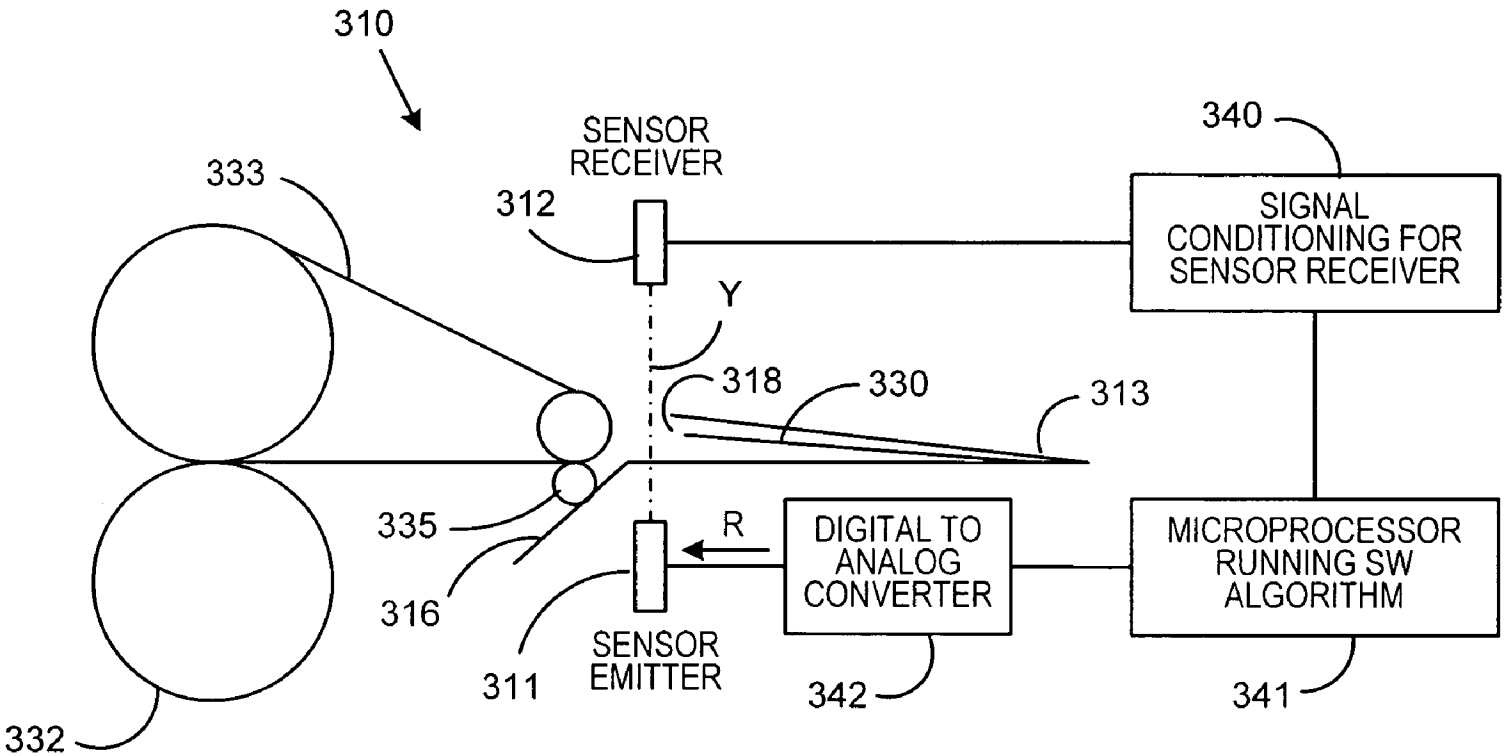
FIG. 9 is a drawing of the insertion system shown in FIG. 6 with an insert fully inserted into the envelope.

FIG. 9 is a drawing of an insertion system with an insert fully inserted into the envelope. The inserts 330 have been driven by the belt drive 333 and the momentum of inserts 30 has carried inserts 330 fully into throat 318 of envelope 313. The trailing edge of inserts 330 has crossed path Y and no longer obstructs the light passing from sensor emitter 311 to sensor receiver 312. Thus, sensor emitter 311 and sensor receiver 312 produce a signal state indicating that the path Y is not blocked. At this point the sensor emitter 311 current is changed from its elevated current S to the reduced current R. The sensor receiver 312 can no longer sense the light produced by sensor emitter 311 and produces a signal state indicating that the path Y is blocked.

The envelope 313 and inserts 330 are then driven out of insertion system 310 and path Y is no longer obstructed by the envelope 313. Thus, sensor receiver 312 has a signal state indicating that path Y is not blocked and system 310 has returned to the condition shown in FIG. 6.

The states of sensor emitter 311 and sensor receiver 332, shown in FIG. 5 describe the current applied to sensor emitter 311 and the response of sensor receiver 312. In state 100 receiver 312 and emitter 311 are in a configuration corresponding to the system 310 shown in FIG. 6, The emitter 311 current is set to R and the receiver 312 is illuminated, producing a signal state indicating that the path Y is not blocked.

A state transition from state 100 to state 101 is caused by an envelope entering the insertion system. At this point the system 310 executes the algorithm described in FIG. 10 which increases the current to a level S. The system is now in the configuration shown in FIG. 7 and transitions to state 102. In state 102 the emitter 311 current equals S and the receiver 312 is illuminated producing a signal state indicating that the path Y is not blocked.

When an insert enters the insertion system and crosses path Y as shown in FIG. 8, the system transitions from state 102 to state 103. In this state path Y is blocked by the insert and the receiver 312 is not illuminated, thus producing a signal indicating path Y is blocked. When the trailing edge of the insert crosses path Y, the receiver 312 is not blocked and senses the illumination provided by the emitter 311. This causes the system to transition from state 103 to state 104, which is shown in FIG. 9.

At this juncture the current to the emitter 311 is restored to a level S and the envelope containing the insert exits the system. The system 310 then transitions back to state 100.

Processing errors may be detected based upon an expected time of transition for this sensor, thereby allowing a timely shutdown of the system in the event of error.

Similar system may be used to detect successive media into an accumulation area and to connect media items accumulated in a stacked form in media processing equipment.

FIG. 10 is a flow chart of a modified binary search that controls the transition from state 101 to state 102. In step 200 a variable is set to high equal to the largest possible current output that can be applied to sensor emitter 311. The in step 201 a variable is set to low equal to the present value R that is applied to the sensor emitter 311 at state 100 (FIG. 5). Now in step 202 a new value is calculated, i.e., NEW which is equal to (HIGH−LOW)/2. Then step 103 applies a current level of NEW to the sensor emitter 311. Next step 204 waits for the sensor receiver 12 to settle. Then step 205 reads the current from the sensor receiver 312 multiple times and computes an average value the receiver 312 response.

At this point step 206 compares the receiver 311 response to a threshold value that defines the condition of a well illuminated sensor receiver. If step 206 determines that the receiver response does not exceed the threshold, the process will go to step 207. Step 207 sets a value LOW equal to the present sensor emitter current value (NEW). Then step 208 computes a differential between the HIGH and LOW values as (high−low)/2. Now step 209 applies a value of (LOW+DELTA) to the sensor emitter 311. Then step 210 sets the state of a flag that indicates the branching that brought the algorithm to this point (LEVEL_BELOW=TRUE). If step 206 determines that the receiver response exceeds the threshold, the process will go to step 211. Step 211 sets a value HIGH equal to the present value (NEW). Then step 212 computes a differential between the HIGH and LOW values as (high−low)/2. Now step 213 applies a value of (HIGH−DELTA) to the sensor emitter 311. Then step 214 sets the state of a flag that indicates the branching that brought the algorithm to this point (LEVEL_BELOW=FALSE).

After the completion of steps 210 or step 214 the next step will be step 215. Step 215 determines whether or not the value of DELTA is greater than zero. If step 215 determines that the value of DELTA is greater than zero, the next step in the process will be step 203. If step 215 determines that the value of DELTA is less than or equal to zero, the next step in the process will be step 216. Step 216 determines whether or not the last state of LEVEL_BELOW is TRUE. If step 216 determines that the last state of LEVEL_BELOW is TRUE, the next step will be step 217. Step 217 increments the value of the current to the emitter by one unit of current. Steps 216 and 217 along with the decision memory developed in steps 210 and 214 represent a modification to traditional binary search algorithms for use with sensor systems. The algorithm now offsets the result to account for landing on or need to offset the result account for landing on the low side of the final threshold.

At the completion of step 217 or if step 216 determines that the last state of the LEVEL_BELOW is not TRUE, the next step will be step 218. Step 218 increments the value of the current to the emitter by a margin value to ensure consistent burn thru. Then in step 219 current applied to the emitter is now equal to S, as shown in state 102 (FIG. 5).

The above specification describes a new and improved method sensing the insertion of an insert into an envelope at the crease line of the envelope and/or an insert just before it is inserted into an envelope. It is realized that the above description may indicate to those skilled in the art additional ways in which the principles of this invention may be used without departing from the spirit. Therefore, it is intended that this invention be limited only by the scope of the appended claims.

What is claimed is:

1. A method for sensing insert insertion approximately at a crease line of an envelope, comprising the steps of:

a) positioning a sensor emitter sensor receiver pair approximately at the crease line of the envelope;

b) modifying the sensor operating parameters so that a body of the envelope causes a state transition of the sensor by the sensor;

c) modifying the sensor operating parameters so that the body of the envelope is no longer sensed;

d) transporting the insert past the sensor into the envelope; and e) monitoring the response of the sensor to detect the presence and absence of the insert in the envelope as the insert is inserted into the envelope.

2. The method claimed in claim 1, wherein the sensor detects the envelope in a first operating state.

3. The method claimed in claim 1, wherein the sensor detects the insert in a second operating state.

4. The method claimed in claim 1, further including the step of:

monitoring the sensors process times to identify envelope jams.

5. The method claimed in claim 1, further including the step of:

monitoring the sensors process times to identify insert jams.

6. The method claimed in claim 1, further including the step of:

monitoring the insertion of the insert completely into the envelope.

7. The method claimed in claim 6, further including the step of:

ejecting the envelope after the insert is completely within the envelope.

8. The method claimed in claim 1, wherein in the first state the emitter has a current which is illuminates the receiver in the absence of the envelope.

9. The method claimed in claim 8, wherein in the first state the emitter has a current whose illumination of the receiver is prevented by the presence of the envelope.

10. The method claimed in claim 8, wherein in the second state the emitter has a current which illuminates the receiver in the presence of the envelope and absence of the insert.

11. The method claimed in claim 8, wherein the second state of the emitter has a current whose illumination of the receiver is prevented by the presence of the insert and the envelope.

12. The method claimed in claim 8, wherein the current to the emitter is modified to accomplish a transition from the first state to the second state.

13. The method claimed in claim 12, wherein the current is modified using a modified binary search.

* * * * *